US007972228B1

(12) United States Patent
Dikmanis et al.

(10) Patent No.: US 7,972,228 B1
(45) Date of Patent: Jul. 5, 2011

(54) LACROSSE HEAD POCKET SHAPER AND PROTECTION DEVICE

(76) Inventors: Andris Dikmanis, Port Washington, NY (US); Indulis Dikmanis, Port Washington, NY (US); James Konatich, Port Washington, NY (US)

( * ) Notice: Subject to any disclaimer, the term of this patent is extended or adjusted under 35 U.S.C. 154(b) by 0 days.

(21) Appl. No.: 12/782,113

(22) Filed: May 18, 2010

(51) Int. Cl.
*A63B 59/02* (2006.01)
*A63B 65/12* (2006.01)

(52) U.S. Cl. ..... 473/513; D21/724

(58) Field of Classification Search ..... 473/505, 473/512, 513, 454; D21/724
See application file for complete search history.

(56) References Cited

U.S. PATENT DOCUMENTS

| | | | | | |
|---|---|---|---|---|---|
| 5,425,541 | A * | 6/1995 | Ambros | 473/513 |
| D362,033 | S * | 9/1995 | Haaning | D21/658 |
| 5,638,999 | A * | 6/1997 | Greene | 223/78 |
| 6,109,997 | A * | 8/2000 | Hatting | 446/103 |
| 7,244,200 | B2 * | 7/2007 | Goldberg | 473/513 |
| 7,445,571 | B2 * | 11/2008 | Winningham | 473/513 |

OTHER PUBLICATIONS

Webpage download, MiraclePounding, 2007,www.amazon.com/gp/product/B00004WCHW/,5 pages.*
Webpage download, CannonSports, 2007,www.amazon.com/CSI-Cannon-Sports-Perforated-Poly/dp/B0000APSB0//,2 pages.*

* cited by examiner

*Primary Examiner* — Gene Kim
*Assistant Examiner* — M Chambers

(57) ABSTRACT

A device for shaping and forming a lacrosse head pocket may comprise a bottom surface, a plurality of side surfaces that form a top surface, and a plurality of openings. The top surface may have a curved surface. The plurality of openings may be at opposite side surfaces of the plurality of side surfaces and the plurality of openings may extend through the opposite side surfaces.

6 Claims, 2 Drawing Sheets

LACROSSE HEAD POCKET SHAPER AND PROTECTION DEVICE

BACKGROUND OF THE INVENTION

The present invention generally relates to a lacrosse head pocket shaper and protection device, and more specifically, relates to a device that may be placed and secured within a lacrosse head pocket in order to make and protect the shape of the lacrosse head pocket.

Currently, lacrosse sticks may include a pocket to catch and release lacrosse balls during a lacrosse game. The position and the shape of the pockets on lacrosse sticks may effect the release and delivery of lacrosse balls during play, where certain pocket shapes may allow more options and versatility in releasing and delivering lacrosse balls.

As can be seen, there is a need for a way to customize the shape of pockets on lacrosse sticks as well as protecting already-shaped pockets on lacrosse sticks.

SUMMARY OF THE INVENTION

In one aspect of the present invention, a device may comprise a bottom surface; a plurality of side surfaces that form a top surface, the top surface having a curved surface; and a plurality of openings at opposite side surfaces of the plurality of side surfaces, the plurality of openings extending through the opposite side surfaces.

In another aspect of the present invention, a method for shaping and forming a lacrosse head pocket may comprise providing a device including a bottom surface; a plurality of side surfaces that form a top surface, the top surface having a curved surface; and a plurality of openings at opposite side surfaces of the plurality of side surfaces, the plurality of openings extending through the opposite side surfaces.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide a lacrosse head pocket protection device that may help form the lacrosse head pocket into a desired shape as well as help keep the shape of and prevent the deformation of a lacrosse head pocket that has already been formed into a desired shape. The lacrosse head pocket protection device may also be used to provide a framework to string lacrosse head pockets.

A lacrosse head pocket may comprise a mesh pocket. The lacrosse head pocket protection device may be made of a solid form having one or more openings running through the device where pins may be inserted through the mesh pocket of the lacrosse head pocket and through openings of the device in order to secure the device into the mesh pocket.

Figure 1:
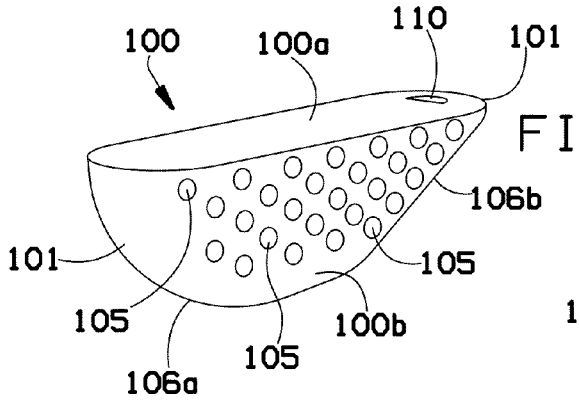
FIG. 1 shows a perspective view of a lacrosse head pocket protection device in accordance with an embodiment of the present invention.
Figure 2:
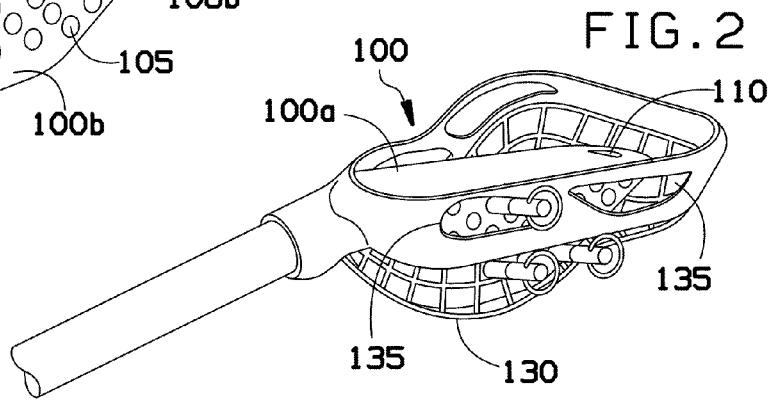
FIG. 2 shows a perspective view of the lacrosse head pocket protection device of FIG. 1 in use with a lacrosse head pocket.
Figure 3:
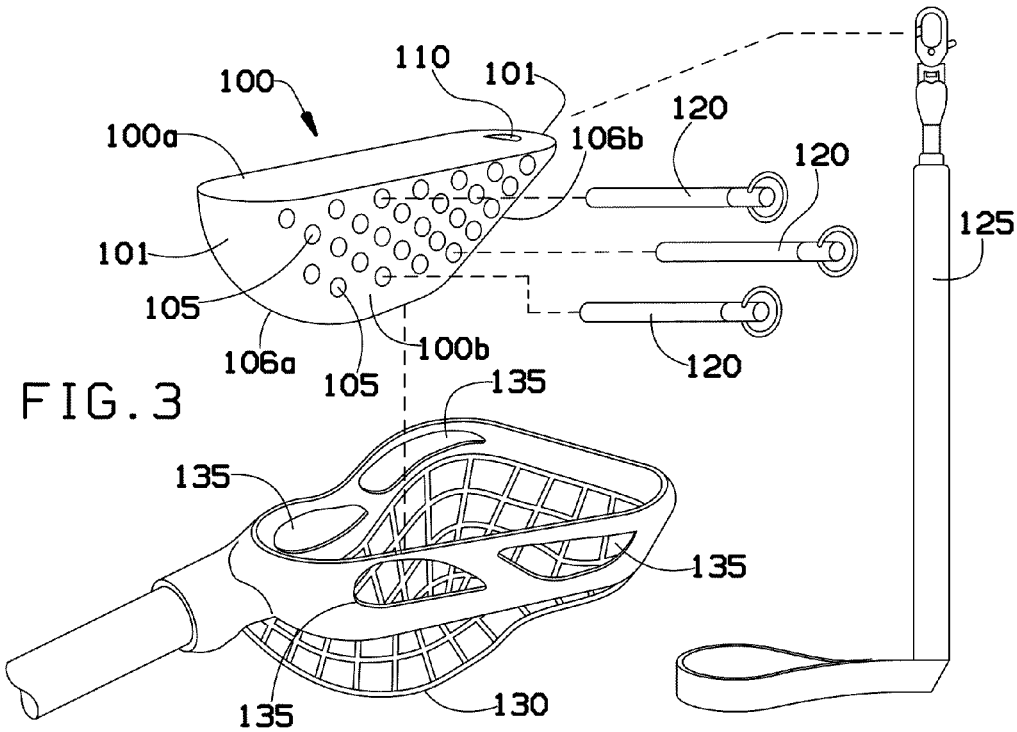
FIG. 3 shows an exploded view of the lacrosse head pocket protection device of FIG. 1 in use with the lacrosse head pocket of FIG. 2.
Figure 4:
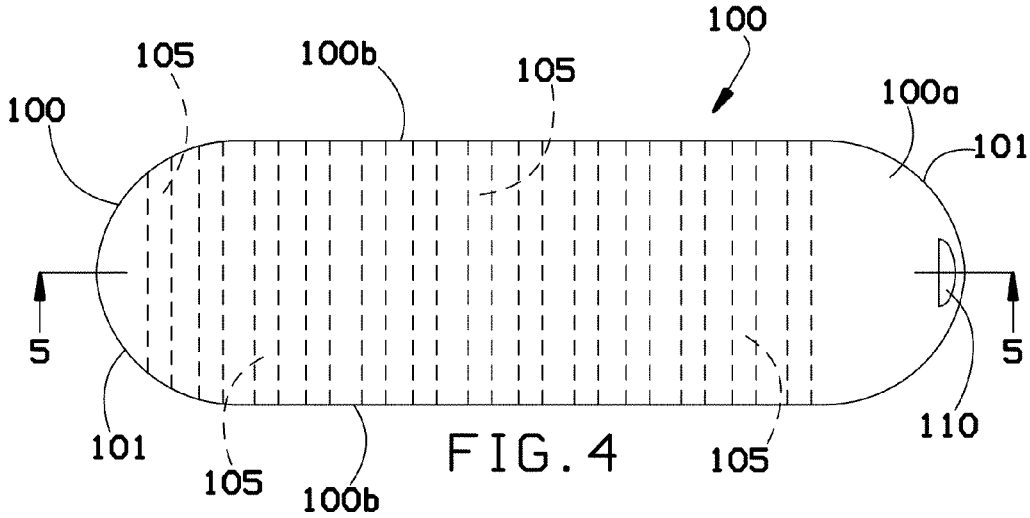
FIG. 4 shows a plan view of the lacrosse head protection device of FIG. 1.
Figure 5:
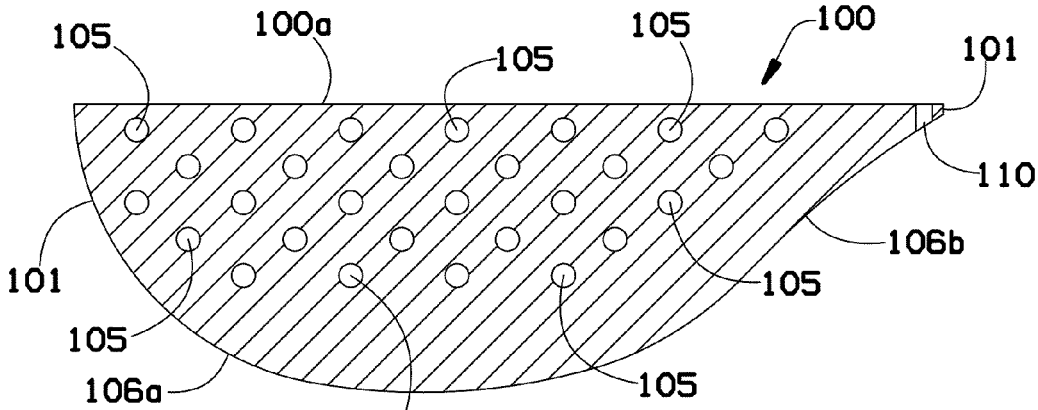
FIG. 5 shows a section view of the lacrosse head protection device of FIG. 1 along line 5-5 in FIG. 4.
Figure 6:
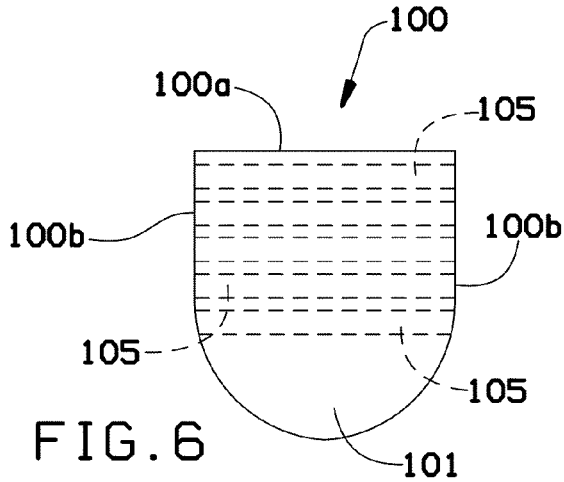
FIG. 6 shows a front view of the lacrosse head protection device of FIG. 1.

Referring now to FIGS. 1 through 6, the lacrosse head pocket protection device 100 may be solid in form and may comprise a base surface 100*a* and two side surfaces 100*b*. The base surface 100*a* may be of a pill shape having two arced ends 101. Each of the side surfaces 100*b* of the device 100 may be of a shape that may include a convex arc portion 106*a* extending from the base surface 100*a* of the device 100 and a concave arc portion 106*b* that extends continuously from the convex arc portion 106*a* to the base surface 100*a*. The two side surfaces 100*b* may meet to form a top surface, thereby forming the device 100 as a solid structure.

In an exemplary embodiment, the side surfaces 100*b* of the device 100 may comprise a single continuous surface extending from the base surface 100*a* and that may be curved according to the convex arc portion 106*a* and the concave arc portion 106*b*.

A plurality of openings 105 may run through opposite side surfaces 100*b* of the device 100. The openings 105 may comprise one or more rows and one or more columns on the side surfaces 100*b* of the device 100 and may be disposed as an offset array of openings 105 on the side surfaces 100*b* of the device 100.

In use, the lacrosse head pocket protection device 100 may be placed topside first into a lacrosse head pocket 130 so that the arc portions 106*a* and 106*b* of the device 100 faces down towards the pocket 130 when the device 100 is situated within the lacrosse head pocket 130. One or more pins 120 may be inserted through openings 135 on the lacrosse head pocket 130 into one or more of the plurality of openings 105 on the lacrosse head pocket protection device 100 in order to secure the device 100 into the lacrosse head pocket 130. Placement of the device 100 within the lacrosse head pocket 130, as well as the placement of the pins 120 through the openings 135 of the lacrosse head pocket 130 and the openings 105 running through the device 100, may depend on the shape of the lacrosse head pocket 130 one wishes to form or protect. For example, the device 100 may be secured via the pins 105 in a position within the lacrosse head pocket 130 so that the device 100 may exert a force on the lacrosse head pocket 130 that may be sufficient to help form the lacrosse head pocket 130 into a desired pocket shape. Alternatively, the device 100 may be secured via the pins 120 in a position within the lacrosse head pocket 130 so that the device 100 exerts little to no force onto the lacrosse head pocket 130, so that the device 100 may be used to protect an already formed shape of the lacrosse head pocket 130.

The pins 120 may also be attached to a cord 125 that may clamp onto the device 100, such as by attaching the cord 125 to a slot 110 on the base surface 100*a* of the device 100, so that the pins 120 may remain attached to the device 100 even when the pins 120 are not inserted into the openings 105 of the device 100.

It should be understood, of course, that the foregoing relates to exemplary embodiments of the invention and that modifications may be made without departing from the spirit and scope of the invention as set forth in the following claims.

We claim:

1. A lacrosse pocket forming device in combination with a lacrosse head and net assembly comprising: a forming device having a flat bottom surface; a plurality of side surfaces that form a top surface, the top surface having a curved surface; consisting of a first convex arc and a second portion comprising a concave arc with respect to said flat bottom surface, resulting in a convex surface formed perpendicular to the plane of the arcs wherein the second curved portion extends continuously from the first curved portion and wherein said first curved portion extends from the flat bottom surface; said device having a plurality of openings on opposite side surfaces wherein said openings extend through said device to the opposite side surfaces and wherein said device has at least one removable in which is insertable into one of the plurality of openings.

2. The device of claim 1, wherein the plurality of openings comprise an offset array of openings.

3. A method for shaping and forming a lacrosse head pocket, utilizing the device of claim 1, comprising:

providing a device including:

a bottom surface;

a plurality of side surfaces that form a top surface, the top surface having a curved surface; and a plurality of openings at opposite side surfaces of the plurality of side surfaces, the plurality of openings extending through the opposite side surfaces.

4. The method of claim 3, further comprising:

disposing the device within a lacrosse head pocket so that one or more of the plurality of side surfaces of the device contacts the lacrosse head pocket.

5. The method of claim 3, further comprising:

securing the device to a lacrosse head pocket.

6. The method of claim 5, further comprising:

inserting a pin through an opening within the lacrosse head pocket into the one of the plurality of openings of the device.

* * * * *